US005931591A

United States Patent [19]

McCracken

[11] Patent Number: 5,931,591

[45] Date of Patent: Aug. 3, 1999

[54] LOTION APPLICATOR

[76] Inventor: Barbara A. McCracken, 5312 Cleveland Rd., Delray Beach, Fla. 33484

[21] Appl. No.: 09/098,367

[22] Filed: Jun. 17, 1998

Related U.S. Application Data

[60] Provisional application No. 60/072,812, Jan. 28, 1998.

[51] Int. Cl.[6] ..... A46B 5/02

[52] U.S. Cl. ..... 401/6; 401/205

[58] Field of Search ..... 401/6, 205, 207, 401/140, 281, 280, 196

[56] References Cited

U.S. PATENT DOCUMENTS

| | | | |
|---|---|---|---|
| 4,889,441 | 12/1989 | Tice | 401/6 |
| 5,240,339 | 8/1993 | DeForest et al. | 401/6 |
| 5,615,962 | 4/1997 | Staub | 401/6 |
| 5,823,206 | 10/1998 | Mapleback | 401/6 |

*Primary Examiner*—David J. Walczak
*Attorney, Agent, or Firm*—Robert M. Downey, PA

[57] ABSTRACT

A device for applying lotion to the skin, and particularly to the back and the legs of a user, includes an elongate handle and head portion with an enlarged base having an annular rim surrounding a mouth and a neck extending from the base and terminating at an open end; the elongate handle being attachable to the open end of the neck and including a removable cap to facilitate filling of lotion within an interior reservoir thereof. A lotion dispensing assembly on the head portion includes a pair of overlying plate members covering the open mouth, the plate members being movable relative to one another to position corresponding apertures formed through each plate member in either an offset relation or an aligned relation, thereby defining closed and open positions to selectively control flow of lotion through the plate members and to an exterior application surface. A cover is removably attachable to the head portion, in covering relation to the plate members, to protect the applicator surface from sand, dirt, and contact with other objects when the device is not in use. Applicator caps of various materials, such as a resilient sponge material, can be removably fitted to the head portion for providing alternative applicator surfaces.

14 Claims, 3 Drawing Sheets

LOTION APPLICATOR

This patent application is based on on provision patent application Ser. No. 60/072,812 filed on Jan. 28, 1998.

BACKGROUND OF THE INVENTION

1. Field of the Invention

The present invention relates to lotion applicator devices and, more particularly, to a lotion applicator device including an elongate handle and a head portion with dispenser means thereon; the handle including a reservoir for containing the lotion therein and the dispenser means including an applicator surface and means for selectively interrupting flow of lotion from the reservoir to the applicator surface.

2. Discussion of the Related Art

It is sometimes necessary to apply a lotion product to one's skin to treat a disorder such as a rash or to prevent dry skin and sunburn. Lotion can be applied to many areas of the body quite readily and effectively using the hands. However, this often leaves a residue on one's hands and objects that are subsequently handled. Furthermore, depending upon the particular composition of the lotion, residue on the hands may leave an unpleasant odor that cannot be covered by clothing. Furthermore, some areas of the body are difficult to reach, such as the back and lower legs, and application of lotion to these areas, using one's own hands, may be difficult if not impossible.

In an attempt to address the above noted problems, others have proposed roll-on applicators and applicators having a sponge attached to an elongate wand or handle. However, these devices have been found to be inadequate for repeated use. Specifically, sponge applicators are difficult to clean and once saturated with oil or lotion, the sponge begins to dry, crack and deteriorate. Moreover, roll-on and sponge applicators are messy and fail to provide means to stop flow of lotion or oil to the applicator surface.

Accordingly, there exists a need in the art for a lotion applicator which is adapted for repeated use to apply lotion to a person's skin, particularly on the back and lower legs without difficulty while keeping the user's hands free of lotion residue.

SUMMARY OF THE INVENTION

A device for applying lotion to the skin, and particularly to the back and the legs of a user, includes head portion with an enlarged base having an annular rim surrounding a mouth and a neck extending from the base and terminating at an open end. An elongate handle removably attaches to the open end of the neck and includes a removable cap to facilitate filling of lotion within an interior reservoir thereof. A lotion dispensing assembly includes a pair of overlying plate members covering the open mouth and each including an array of apertures formed therethrough, the plate members being movable relative to one another to arrange the corresponding apertures in either an offset relation or an aligned relation, thereby defining closed and open positions, respectively. With the corresponding apertures of the plate members disposed in the aligned, open position, lotion is permitted to flow from the interior reservoir to an exterior convex applicator surface of an outermost one of the plate members for application to the skin upon moving the exterior applicator surface against the skin. In the closed position, flow of lotion to the applicator surface is prevented, thereby enabling the device to be stored or carried in a purse or handbag without the contents leaking therefrom. A cover is removably attachable to the head portion, in covering relation to the plate members, to protect the applicator surface from sand, dirt, and contact with other objects when the device is not in use. Applicator caps of various materials, such as a resilient sponge material, can be removably fitted to the head portion for providing alternative applicator surfaces.

OBJECTS AND ADVANTAGES OF THE PRESENT INVENTION

It is a primary object of the present invention to provide a device to facilitate application of lotions, oils and the like to the skin, and particularly to areas on one's own skin which are difficult to reach with the hands.

It is a further object of the present invention to provide a device for applying lotions, oils, topical medicaments, and the like to the skin without the applied substance contacting the user's hands, thereby avoiding residue and/or unpleasant odors from remaining on one's hands after application.

It is still a further object of the present invention to provide a device for applying lotions, oils and the like to areas of the body which are difficult to reach, such as the back and lower legs.

It is still a further object of the present invention to provide a lotion applicator device, as described herein, which can be easily carried in a large purse, suitcase or beach bag.

It is still a further object of the present invention to provide a lotion applicator device, as described herein, which is adapted to contain a charge of lotion, oil or other topically applied substance selected by the user.

It is yet a further object of the present invention to provide a lotion applicator, as described herein, which is relatively inexpensive, easy to use, and easy to clean.

It is still a further object of the present invention to provide a lotion applicator, as described herein, which contains a charge of lotion, oil or other topically applied substance, and wherein the device includes means to selectively control flow of the substance from an interior reservoir to an exterior applicator surface of the device.

These and other objects and advantages of the present invention are more readily apparent with reference to the detailed description and accompanying drawings.

BRIEF DESCRIPTION OF THE DRAWINGS

For a fuller understanding of the nature of the present invention, reference should be had to the following detailed description taken in conjunction with the accompanying drawings in which:

FIG. 5A is an isolated sectional view illustrating attachment of the retaining plate and applicator plate to an annular rim of the head portion, wherein apertures formed through the retaining plate are disposed in offset, non-aligned relation to apertures in the dispenser plate, thereby defining a closed position wherein lotion within the interior reservoir of the device is unable to flow to an exterior applicator surface of the applicator plate;

FIG. 5B is an isolated sectional view of the head portion, wherein the applicator plate has been rotated to an open position, to thereby align the apertures on the retaining plate with the apertures on the applicator plate so that lotion is able to flow to the exterior applicator surface;

Like reference numerals refer to like parts throughout the several views of the drawings.

DETAILED DESCRIPTION OF THE PREFERRED EMBODIMENT

Figure 1:
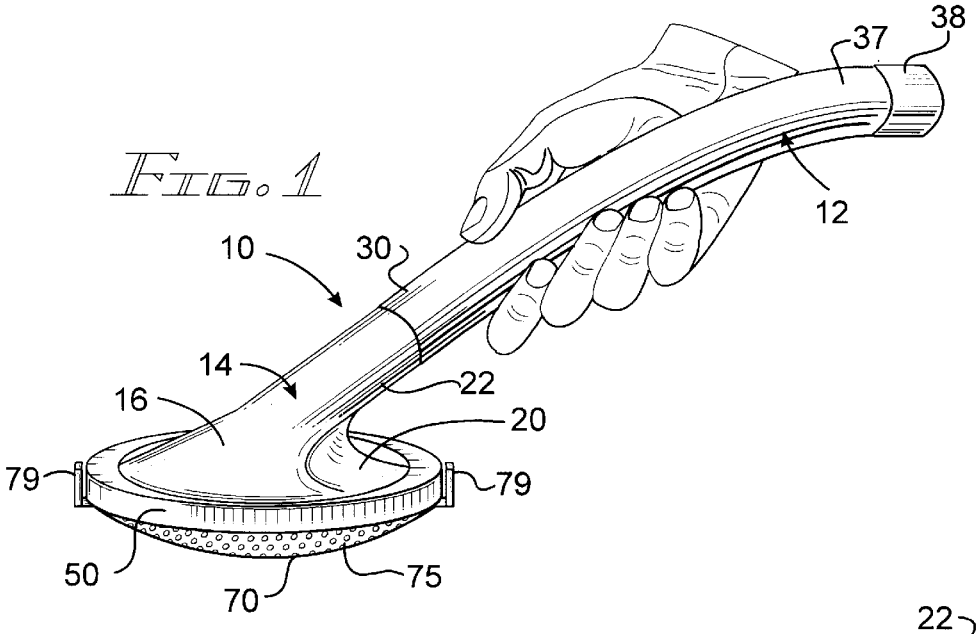
FIG. 1 is a perspective view of the lotion applicator device of the present invention shown in the hand of a user.
Figure 2:
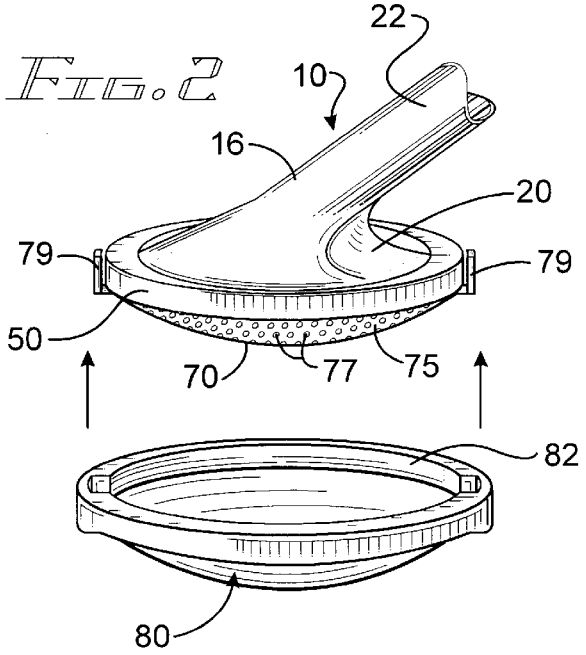
FIG. 2 is an isolated, exploded perspective view of a head portion of the device.
Figure 3:
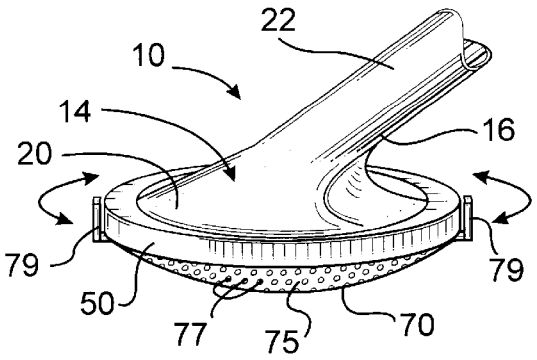
FIG. 3 is a perspective view of the head portion illustrating movement of an applicator plate, in relation to a retaining plate to thereby open and close a lotion dispensing assembly on the head portion.
Figure 4:
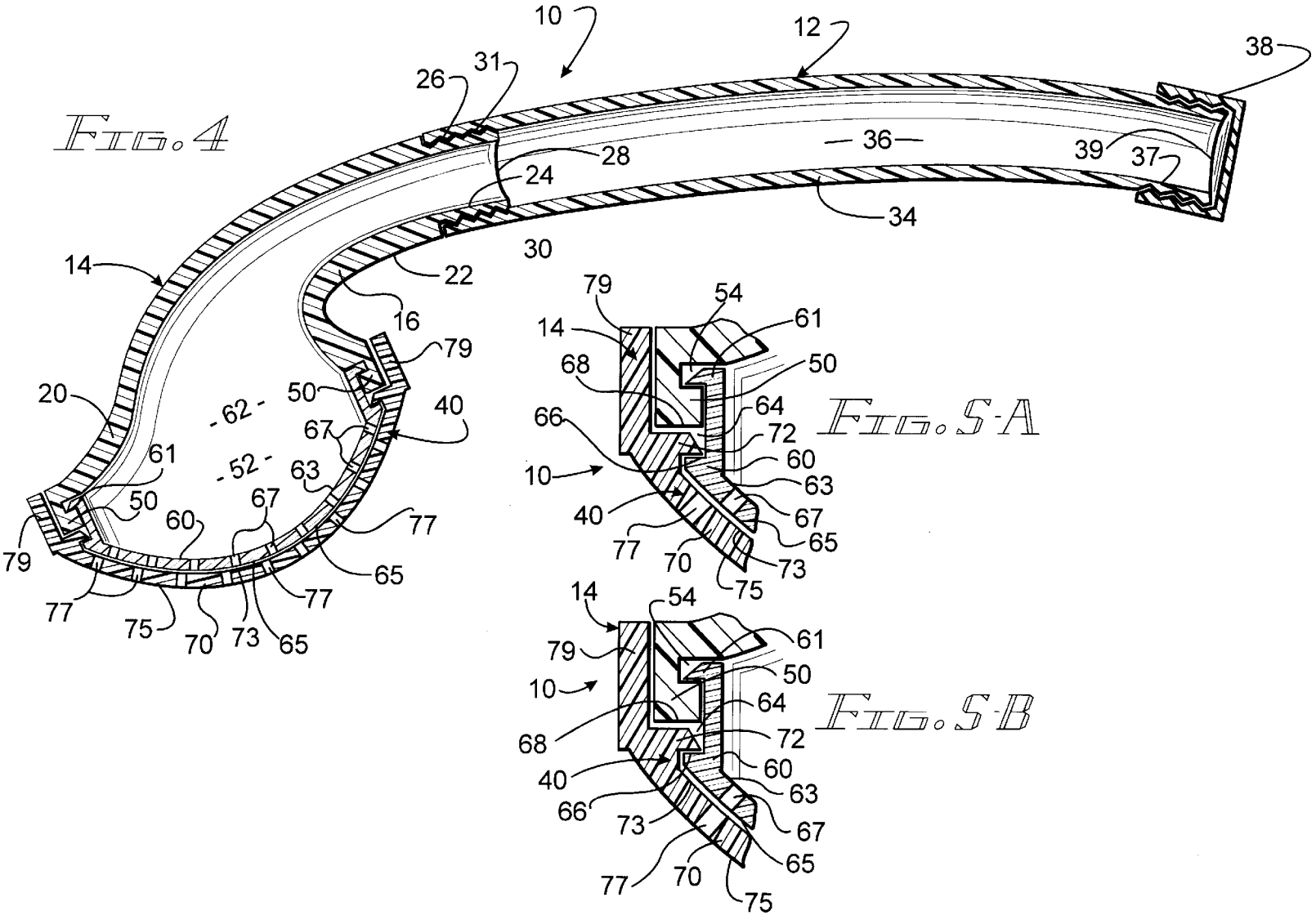
FIG. 4 is a side sectional view of the lotion applicator device of FIG. 1.

Referring initially to FIGS. 1–5B, the lotion applicator device 10 of the present invention is shown and described in accordance with a preferred embodiment thereof. The device 10 includes an elongate handle 12 and a head portion 14. The head portion 14 includes an integrally formed body 16 defined by a flared, generally skirted base 20 and an integral neck 22 extending from the base 20. The neck 22 includes a distal neck zone 24 having a reduced exterior diameter with thread means 26 thereon and terminating at an open end 28. The distal neck zone is structured and configured for removable attachment of a distal end 30 of the elongate handle 12 thereto, wherein an interior threaded surface 31 of the elongate handle threadably engages the exterior threaded surface on the distal neck zone.

The elongate handle 12 is defined by a generally hollow, tubular structure having a wall 34 surrounding an interior reservoir 36. The surrounding, tubular wall 34 of the handle 12 may be formed of either a rigid material or a resilient, collapsible material. A proximal end 37 of the handle 12 is provided with removable cap means 38 to facilitate filling of lotion, oil or other topically applied substances through an open end 39 of the handle 12. The cap means may be removably secured by threaded engagement, frictional engagement, or other well known means for removably attaching a cap to an open end of a vessel. The lotion reservoir 36 within the handle is sized and disposed for receipt of a sufficient charge of lotion, oil, or other topically applied substance therein to accommodate at least one typical application of the substance to the exposed skin areas of the user's body. It is contemplated that the device be used for the application of products such as suntan lotion, suntan oils, moisturizers, medicated lotions, and the like.

The head portion 14 is provided with a dispenser assembly 40 for selectively controlling flow of lotion, oil, etc. from within the device to an exterior applicator surface. Specifically, the base 20 of the head portion 14 flares outwardly from the neck 22 to an annular rim 50 surrounding a mouth 52 of the base portion. The annular rim 50 is provided with a notch 54 for attached receipt of an annular lip on a retainer plate 60, for attaching the retainer plate 60 to the base portion in covering relation to the mouth, thereby enclosing an interior chamber 62 of the head portion. The interior chamber 62 is disposed in fluid communication with the reservoir 36 in the handle and becomes progressively larger from the neck opening 28 to the mouth 52.

In the preferred embodiment, the retainer plate 60 includes an inner concave surface 63, an outer convex surface 65, and a plurality of apertures 67 formed through a thickness of the retainer plate from the concave surface 63 to the convex surface 65. When the retainer plate is fitted to the base, an annular channel 64 is formed between a shoulder 66 on the exterior of the retainer plate and a bottom face 68 of the annular rim 50 for accommodating an inwardly protruding guide member 72 formed on an applicator plate 70, thereby securing the applicator plate 70 to the retainer plate 60 and permitting the applicator plate 70 to rotate relative to the retainer plate 60. As seen throughout the several views of the drawings, the applicator plate is congruently configured to the retainer plate and includes an inner concave surface 73 disposed in close spaced relation to the convex surface 65 of the retainer plate. The applicator plate further includes an outer convex surface 75 defining an applicator surface. Similar to the retainer plate, the applicator plate includes a plurality of apertures 77 formed therethrough between the inner concave surface 73 and the outer convex surface 75. Rotating the applicator plate 70 serves to move the apertures 77 in relation to the apertures 67 on the retainer plate 60. In a first, closed position, the applicator plate is positioned and disposed so that the apertures 77 are offset (not aligned) with the apertures 67 in the retainer plate, thereby preventing fluid flow of the contents within the reservoir and interior chamber through the dispensing assembly 40 to the exterior applicator surface 75. Upon rotating the applicator plate through a partial revolution (approximately 90°), the apertures 77 therein are moved so that they become aligned with the apertures 67 in the retainer plate, as seen in FIG. 5B, thereby permitting fluid flow of the contents within the device to the exterior applicator surface on the applicator plate. One or more finger elements 79 may be provided on the applicator plate, extending upwardly and radially outward of the annular rim 50, to facilitate grasping with the fingers for rotational movement of the applicator plate between the closed position (see FIG. 5A) to the open position (see FIG. 5B).

A cover 80 (see FIG. 2) is structured and configured for removable attachment to the annular rim of the base. In a preferred embodiment, an annular lip 82 is provided with an inner diameter which is slightly greater in diameter than an outermost diameter of the annular rim 50, thereby providing a frictional, releasable engagement of the cover 80 to the base. The cover is congruently configured to overly the outer applicator surface 75 of the applicator plate, thereby covering the applicator surface and the apertures to prevent contact of the applicator surface with sand, dirt, and other articles when the device is not in use.

Figures 6, 7, 8:
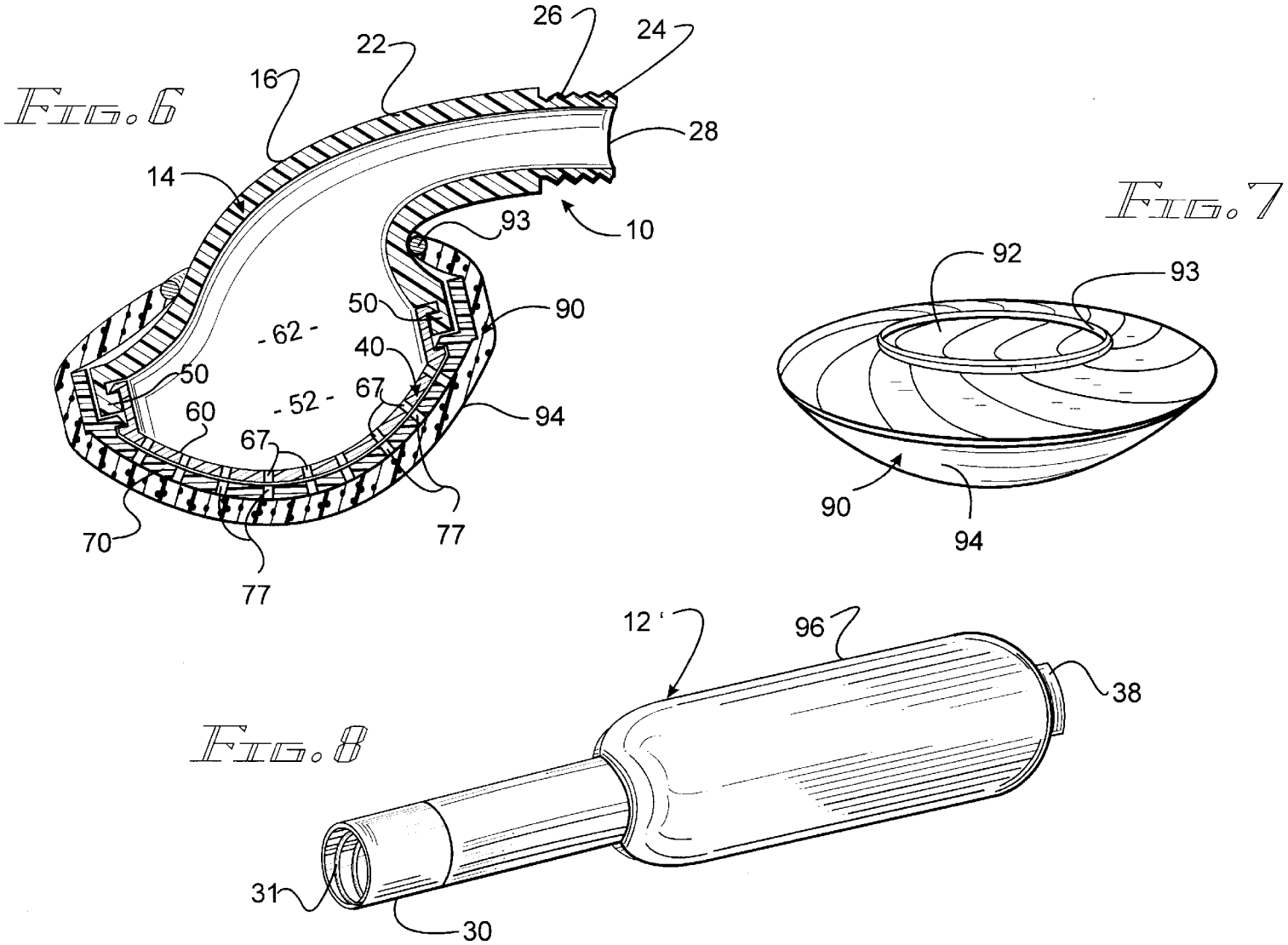
FIG. 6 is an isolated sectional view of the head portion in accordance with an alternative embodiment thereof, wherein a sponge applicator cap is fitted to the head portion in covering relation to the applicator surface of the applicator plate.
FIG. 7 is a perspective view of the sponge applicator cap.
FIG. 8 is a perspective view of an alternative embodiment of the elongate handle portion, wherein the handle is provided with an enlarged portion formed of a flexible, resilient material surrounding a hollow interior reservoir for containing lotion therein.

FIGS. 6 and 7 illustrate an alternative embodiment, wherein a removable applicator cap 90 is provided for attachment over the head portion 14, and particularly the applicator surface of the applicator plate. The applicator cap 90 may be formed of any suitable material to provide an alternative texture and feel. In one embodiment, the applicator cap may be formed of a sponge rubber membrane material which is soft, resilient and adapted to permit penetration of lotion, oil and other substances therethrough. A reduced diameter opening 92 in the cap 90 is surrounded by an elastomeric band 93 to permit stretching and enlarging of the opening 92 in order to allow the cap to be fitted over the enlarged head portion. Upon releasing a stretching force, the elastomeric band about the opening of the applicator cap assumes a relaxed position in snug engagement about the neck of the head portion, thereby retaining the applicator cap on the head portion with a bottom side 94 fitted tightly against the applicator surface 75, as seen in FIG. 6. The applicator cap is easily removable to facilitate washing thereof. Alternatively, the applicator cap may be made as a disposable accessory for one time use.

FIG. 8 illustrates an alternative embodiment of the handle 12', wherein at least a portion of the handle 12' is defined by an enlarged, generally bulbous portion 96 to accommodate receipt of a larger charge of lotion, oil or other substance therein. The enlarged portion 96 of the handle may be formed of a resilient material, such as rubber, to permit squeezing thereof in order to collapse the interior reservoir 36 and thereby force the contents therein towards the mouth 52 and dispensing assembly 40 on the head portion.

While the instant invention has been shown in accordance with what is considered to be preferred and practical embodiments thereof, it is recognized that departures may be made within the spirit and scope of the present invention which, therefore, should not be limited except as defined in the following claims and within the doctrine of equivalents.

What is claimed is:

1. A device for applying lotion to a user's skin comprising:

an elongate handle having a proximal end, an open distal end, and a central zone between the proximal and distal ends, said handle further including an interior reservoir for containing the lotion therein, said proximal end including fill means for filling the interior reservoir with lotion;

a head portion including:

a base having an outwardly flared wall structure with an annular rim surrounding a mouth;

a neck integral with said base and extending from said outwardly skirted wall and terminating at an open end, said neck including means for removable attachment of said head portion to said distal end of said elongate handle so that said interior reservoir and said mouth are disposed in fluid flow communication;

applicator means for discharging the lotion and applying the lotion to the user's skin and including an exterior applicator surface structured and disposed for contacting the user's skin and releasing the lotion to the user's skin; and means for selectively controlling fluid flow of the lotion from said interior reservoir to said applicator surface, and including a pair of plates fitted to said base, adjacent said mouth, and being movable relative to one another, said plates each including a plurality of apertures formed therethrough, a first one of said plates being movable relative to a second one of said plates to move the apertures on the respective plates between an offset position and an axially aligned position, wherein said offset position defines a closed position preventing fluid flow through said plates and, wherein said aligned position defines an open position permitting fluid flow through said plates, said first one of said plates including an outer exposed surface having a convex configuration and defining said exterior applicator surface.

2. A device as recited in claim 1 further including cover means removably attachable to said head portion for covering said exterior applicator surface.

3. A device as recited in claim 1 wherein said applicator means further includes a removable cap formed of a flexible material and being structured and disposed for removable attachment to said head portion in covering relation to said exterior applicator surface, said flexible material of said cap being adapted to permit passage of the lotion therethrough for application to the user's skin.

4. A device as recited in claim 3 wherein said flexible material of said cap includes a sponge material.

5. A device as recited in claim 1 wherein said elongate handle is formed at least partially of a resilient, flexible material to permit squeezing of said handle and collapsing of said interior reservoir to thereby urge the lotion towards said distal end.

6. A device as recited in claim 5 wherein said elongate handle further includes an enlarged portion formed of said flexible, resilient material to provide an area of increased volume of said interior reservoir.

7. A device for applying lotion to a user's skin comprising:

an elongate handle having a proximal end, an open distal end, and a central zone between the proximal and distal ends, said handle further including an interior reservoir for containing the lotion therein, said proximal end including fill means for filling the interior reservoir with lotion;

a head portion including:

a base having an outwardly flared wall structure with an annular rim surrounding a mouth;

a neck integral with said base and extending from said outwardly skirted wall and terminating at an open end, said neck including means for removable attachment of said head portion to said distal end of said elongate handle so that said interior reservoir and said mouth are disposed in fluid flow communication;

applicator means for discharging the lotion and applying the lotion to the user's skin and including an exterior applicator surface structured and disposed for contacting the user's skin and releasing the lotion to the user's skin; and means for selectively controlling fluid flow of the lotion from said interior reservoir to said applicator surface and including a pair of plates fitted to said base, adjacent said mouth, said pair of plates being movable relative to one another and each including a plurality of apertures formed therethrough, a first one of said plates being movable relative to a second one of said plates to move the apertures on the respective plates between an offset position and an axially aligned position, wherein said off position defines a closed position preventing fluid flow through said plates and, wherein said aligned position defines an open position permitting fluid flow through said plates.

8. A device as recited in claim 7 further including cover means removably attachable to said head portion for covering said exterior applicator surface.

9. A device as recited in claim 8 wherein said first one of said plates includes an outer exposed surface defining said exterior applicator surface.

10. A device as recited in claim 9 wherein said exterior applicator surface includes a convex configuration.

11. A device as recited in claim 7 wherein said applicator means further includes a removable cap formed of a flexible material and being structured and disposed for removable attachment to said head portion in covering relation to said exterior applicator surface, said flexible material of said cap being adapted to permit passage of the lotion therethrough for application to the user's skin.

12. A device as recited in claim 11 wherein said flexible material of said cap includes a sponge material.

13. A device as recited in claim 7 wherein said elongate handle is formed at least partially of a resilient, flexible material to permit squeezing of said handle and collapsing of said interior reservoir to thereby urge the lotion towards said distal end.

14. A device as recited in claim 13 wherein said elongate handle further includes an enlarged portion formed of said flexible, resilient material to provide an area of increased volume of said interior reservoir.

* * * * *